United States Patent [19]

Schmitz et al.

[11] 4,335,364

[45] Jun. 15, 1982

[54] TRANSITION FROM A COAXIAL CABLE TO A MULTIPOLE PLUG-IN CONNECTOR

[75] Inventors: Johannes Schmitz; Roland Röhrbein, both of Backnang, both of Fed. Rep. of Germany

[73] Assignee: Licentia Patent-Verwaltungs-GmbH, Frankfurt am Main, Fed. Rep. of Germany

[21] Appl. No.: 211,787

[22] Filed: Dec. 1, 1980

[30] Foreign Application Priority Data

Dec. 6, 1979 [DE] Fed. Rep. of Germany ..... 2949013

[51] Int. Cl.[3] ..... H01P 5/08

[52] U.S. Cl. ..... 333/33; 333/238; 333/260; 339/17 LC

[58] Field of Search ..... 333/33, 238, 246, 260; 339/17 C, 17 LC; 361/413

[56] References Cited

U.S. PATENT DOCUMENTS 3,643,201 2/1972 Harwood ..... 333/260 X
3,678,395 7/1972 Hunton et al. ..... 333/238 X
4,129,897 12/1978 Telewski et al. ..... 333/238 X

*Primary Examiner*—Paul L. Gensler
*Attorney, Agent, or Firm*—Spencer & Kaye

[57] ABSTRACT

A transition piece for establishing a transition between a coaxial cable having an inner conductor and an outer conductor and a plug-in connector component having a plurality of terminals disposed adjacent one another, composed of a coupling member in the form of a coplanar stripline presenting a conductive strip and a conductive surface surrounding, and electrically insulated from, the conductive strip, the coupling member being connected to the coaxial cable and the connector component in such a manner that the inner conductor of the cable is connected to a point at one end of the conductive strip, the outer conductor of the cable is connected to the conductive surface, a first terminal of the connector component is connected to a point at the end of the conductive strip opposite its one end, and at least one terminal adjacent the first terminal is connected to the conductive surface.

4 Claims, 3 Drawing Figures

TRANSITION FROM A COAXIAL CABLE TO A MULTIPOLE PLUG-IN CONNECTOR

BACKGROUND OF THE INVENTION

The present invention relates to a transition piece for connecting a coaxial cable to a multipole plug-in connector.

Customarily, a releasable connection between two coaxial cables or between a coaxial cable and another type of component consists of a coaxial plug-in connector. Existing coaxial plug-in connectors meet high requirements, e.g. regarding attenuation of reflections or reduction of transmission losses. Therefore, they are suitable for the transmission of analog signals. However, attainment of this high electrical quality requires very precise manufacturing, which makes such connectors very expensive.

Transmission of digital signals generally does not place such great demands on the plug-in connector with regard to crosstalk attenuation, the attenuation of reflections or reduction of transmission losses as does the transmission of analog signals. Crosstalk attenuation and the attenuation of reflections or reduction of transmission losses, respectively, at the points of connection may have somewhat less favorable values than required for the transmission of analog signals without noticeably adversely influencing digital signal transmission.

Such a coaxial plug-in connector would offer an unnecessarily high electrical quality when used under these conditions and would therefore make the devices in which they are employed unnecessarily expensive.

SUMMARY OF THE INVENTION

It is therfore an object of the present invention to enable a multipole plug-in connector to be connected to a coaxial cable by means of an easily manufactured transition piece.

The above and other objects are achieved, according to the invention, by the provision of a transition piece for establishing a transition between a coaxial cable having an inner conductor and an outer conductor and a plug-in connector component having a plurality of terminals disposed adjacent one another, which piece is composed of a coupling member in the form of a coplanar stripline presenting a conductive strip and a conductive surface surrounding, and electrically insulated from, the conductive strip, means connecting the inner conductor of the cable to a point at one end of the conductive strip, means connecting the outer conductor of the cable to the conductive surface, means connecting a first terminal of the connector component to a point at the end of the conductive strip opposite its one end, and means connecting at least one terminal adjacent the first terminal to the conductive surface.

According to a suitable embodiment of the present invention the points of contact at the outer conductor of the coaxial cable are arranged to be symmetrically distributed over the conductive surface of the coplanar stripline around the point of contact of the inner conductor of the coaxial cable with the conductor strip, the points of contact of the plug-in connector are likewise arranged symmetrically on the conductive surface around the point of contact of the plug-in connector with the conductor strip, and the ratio between the width of the conductor strip and the width of the recess in the conductive surface of the coplanar stripline accommodating the conductor strip is selected in such a manner that the characteristic impedance of the coaxial cable is matched to that of the plug-in connector. The characteristic impedance $Z_b$ of the coplanar stripline is determined, in dependence on the dielectric constant $\epsilon_r$ of the base material and on the ratio between the width, B, of the recess in the conductive surface and the width, b, of the conductor strip, according to the equation:

$$Z_b = \sqrt{\frac{1}{\epsilon_r}} \left( 83.2 + 60 \ln \frac{B}{b} \right) .$$

DESCRIPTION OF THE PREFERRED EMBODIMENTS

Figure 1:
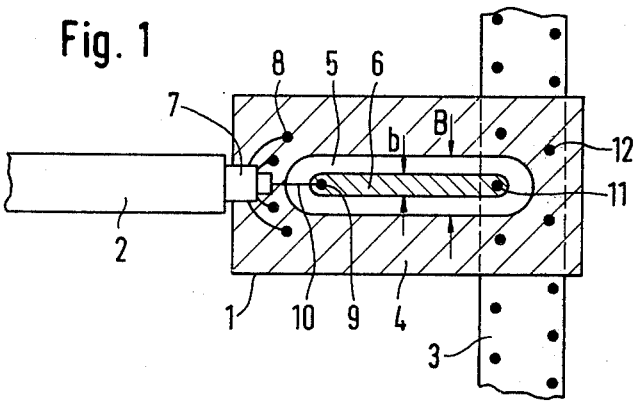
FIG. 1 is a plan view of a preferred embodiment of a transition piece according to the invention for connecting a coaxial cable to a multipole plug-in connector.

FIG. 1 shows a transition piece according to the invention composed of a coplanar stripline 1 connected between a coaxial cable 2 and a multipole plug-in connector 3 which can be of a commercially available type. The coplanar stripline 1 has a conductive surface 4 in which is provided an elongate recess 5 of a width B. Recess 5 encloses a strip-like conductive surface portion 6 of a width b, insulated from the conductive surface 4 by recess 5. The characteristic impedance of this coplanar stripline depends, in addition to the dielectric constant $\epsilon_r$ of the base material, on the ratio between the width B of the recess 5 and the width b of the conductor strip 6, the width dimensions being perpendicular to the direction between cable 2 and connector 3. The characteristic impedance of the coplanar stripline can be determined by means of the following equation:

$$Z_b = \sqrt{\frac{1}{\epsilon_r}} \left( 83.2 + 60 \ln \frac{B}{b} \right) .$$

The characteristic impedance $Z_b$, is dimensioned, according to the invention, in such a way that optimum matching results between the characteristic impedance of the coaxial cable and that of the multipole plug-in connector. The book by Meinke/Gundlach entitled, "Taschenbuch der Hochfrequenztechnik" [Hand-Book of the High Frequency Art], , published by Springer Verlag 1968, 3rd edition, page 384, shows that impedance matching exists whenever the characteristic impedance of the matching line is equal to the geometric mean of the two resistances to be matched.

In order to attain low transmission losses or a high attenuation of reflections in the transition piece, the connection of the coaxial cable 2 and of the multipole plug-in connector 3 to the coplanar stripline 1 should be effected in such a way that the homogeneity of the field on the coplanar stripline is interfered with as little as possible. For that reason, the outer conductor 7 of the coaxial cable is connected at several places 8 to the conductive surface 4, e.g. by being soldered thereto.

The four contact points of the outer conductor shown here are arranged in the vicinity of the point of contact 9 of the inner coaxial cable conductor 10 with one end of the conductor strip 6 and are disposed symmetrically in a semicircle around this point of contact 9.

One pin 11 of the multipole plug-in connector 3 is connected to the other end of the coplanar stripline and the connector pins 12 adjacent pin 11, whose position is determined by the type of multipole plug-in connector 3, are in contact with the conductive surface 4. Here again, in order not to interfere with the homogeneity of the electric field, the pins 12 are arranged symmetrically around the point of contact of the pin 11 with the conductor strip and contact the conductive surface.

Two examples for use of the above-described coaxial connection will now be given.

Figure 2:
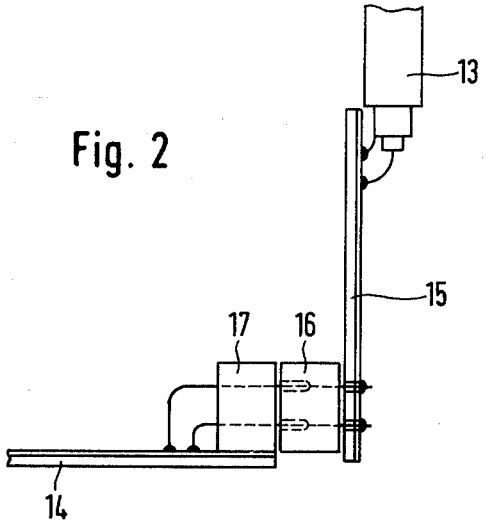
FIG. 2 is an elevational view of a plug-in connection between a coaxial cable and the carrier of a group of components using the transition piece of FIG. 1.

FIG. 2 shows a releasable connection of a coaxial cable 13 with a group of components on a carrier 14 which may be a printed circuit. The coaxial cable 13 is connected to one end of a coplanar stripline 15 corresponding to coplanar stripline 1 of FIG. 1, and the other end of coplanar stripline 15 is connected to a female multipole connector 16 in the manner described for connector 3 in connection with FIG. 1. A male multipoint connector 17 is disposed on the carrier 14 and is plugged into the connector 16. A coplanar stripline structure similar to that of FIG. 1 establishing the connection and impedance matching between the male multipoint connector and the component group is likewise provided on the carrier 14.

Inserts for accommodating carriers of component groups have, in the prior art, often been equipped with expensive coaxial plugs for making the very many connections required for coaxial cables. A considerable savings in such inserts results if all coaxial plugs are replaced by economical multipole plug-in connectors with coplanar striplines connected thereto as transition pieces for the coaxial cables. In this case, a plurality of coplanar striplines can be arranged on one plate and that plate can be equipped with a series of multipole plug-in connectors and disposed on the rear side of an insert.

Figure 3:
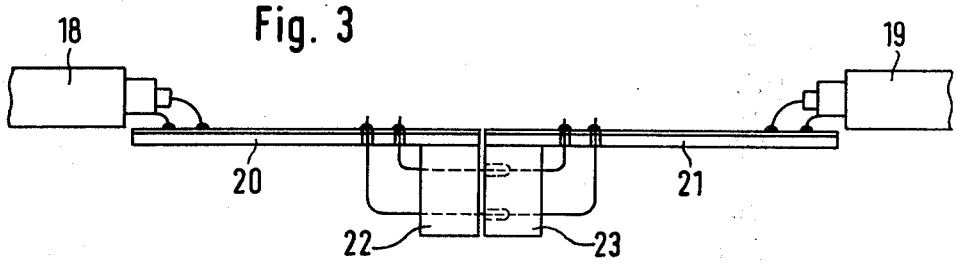
FIG. 3 is an elevational view of a plug-in connection between two coaxial cables, using two of the transition pieces of FIG. 1.

A further example for use of the invention is shown in FIG. 3 in the form of a plug-in connection between two coaxial cables. The two coaxial cables 18 and 19 are each contacted with a respective coplanar stripline 20 or 21. One coplanar stripline is connected to a male connector 22 which is plugged into the female connector 23 connected to the other coplanar stripline.

The impedance match between the coaxial cable 2, the coplaner stripline 1 and the multipole plug-in connector 3 becomes the better the more connection points 8, 12 are symmetrically disposed on the conductive surface 4 around the points of contact 9, 11 on the ends of the conductor strip 6 and the smaller the distances between the connection points are.

It will be understood that the above description of the present invention is susceptible to various modifications, changes and adaptations, and the same are intended to be comprehended within the meaning and range of equivalents of the appended claims.

What is claimed is:

1. A transition piece for establishing a transition between a coaxial cable having an inner conductor and an outer conductor and a plug-in connector component having a plurality of terminals disposed adjacent one another, comprising a coupling member in the form of a coplanar stripline presenting a conductive strip and a conductive surface surrounding, and electrically insulated from, said conductive strip, means connecting the inner conductor of the cable to a point at one end of said conductive strip, means connecting the outer conductor of the cable to said conductive surface, means connecting a first terminal of the connector component to a point at the end of said conductive strip opposite its said one end, and means connecting at least one terminal adjacent the first terminal to said conductive surface.

2. A transition piece as defined in claim 1 wherein said means connecting the outer cable conductor connect that outer conductor to said conductive surface at a plurality of spaced points distributed symmetrically about the point of connection of the inner cable conductor to said conductive strip, and said means connecting at least one terminal connect a plurality of terminals adjacent the first terminal to said conductive surface at a plurality of spaced points distributed symmetrically about the point of connection of the first terminal to said conductive strip.

3. A transition piece as defined in claim 1 or 2 wherein said conductive surface presents a recess within which said conductive strip is disposed and said strip and surface are configured such that, in a direction transverse to the direction between the two ends of said strip, the dimensions of said recess and said strip have a ratio to one another selected for matching the characteristic impedance of the cable to the characteristic impedance of the connector component.

4. A transition piece as defined in claim 3 wherein said coplanar stripline includes an insulating support on which said strip and surface are disposed and the characteristic impedance of said coplanar stripline is equal to $$\sqrt{\frac{1}{\epsilon_r}}\left(83.2 + 60 \ln \frac{B}{b}\right).$$

where $\epsilon_r$ = the relative dielectric constant of said support

B = said dimension of said recess transverse to the direction between said strip ends; and b = said dimension of said strip transverse to the direction of said strip ends.

* * * * *